US012442112B2

(12) United States Patent
Jiang et al.

(10) Patent No.: US 12,442,112 B2
(45) Date of Patent: Oct. 14, 2025

(54) FULL-FORM FLAT-KNITTED HELMET SHELL PREFORM, PREPARATION METHOD, AND HELMET SHELL THEREOF

(71) Applicant: JIANGNAN UNIVERSITY, Wuxi (CN)

(72) Inventors: Gaoming Jiang, Wuxi (CN); Honglian Cong, Wuxi (CN); Jiangtao Tan, Wuxi (CN); Peixiao Zheng, Wuxi (CN)

(73) Assignee: JIANGNAN UNIVERSITY, Wuxi (CN)

( * ) Notice: Subject to any disclaimer, the term of this patent is extended or adjusted under 35 U.S.C. 154(b) by 178 days.

(21) Appl. No.: 18/325,175

(22) Filed: May 30, 2023

(65) Prior Publication Data

US 2024/0167203 A1 May 23, 2024

Related U.S. Application Data

(63) Continuation of application No. PCT/CN2021/119235, filed on Sep. 18, 2021.

(30) Foreign Application Priority Data

Mar. 15, 2021 (CN) ..... 202110289669.7

(51) Int. Cl.
*D04B 1/24* (2006.01)
*A42C 2/00* (2006.01)
*D04B 1/16* (2006.01)

(52) U.S. Cl.
CPC ..... *D04B 1/24* (2013.01); *A42C 2/00* (2013.01); *D04B 1/16* (2013.01)

(58) Field of Classification Search
CPC ... D04B 1/24; D04B 7/30; D04B 7/10; D04B 7/14; A42B 3/062; A42B 3/063; A42C 2/00; A42C 2/002; A42C 2/005
See application file for complete search history.

(56) References Cited

U.S. PATENT DOCUMENTS 5,857,215 A * 1/1999 Fergason ..... B29C 66/7394 2/8.8
6,012,178 A * 1/2000 Schuster ..... B32B 5/28 2/2.5

(Continued)

FOREIGN PATENT DOCUMENTS

CN 102313492 A 1/2012
CN 105153647 A 12/2015

(Continued)

OTHER PUBLICATIONS

International Search Report and Written Opinion issued in related International Application No. PCT/CN2021/119235; mailed Dec. 8, 2021; 16 pgs.

(Continued)

*Primary Examiner* — Danny Worrell
(74) *Attorney, Agent, or Firm* — HAUPTMAN HAM, LLP

(57) ABSTRACT

Disclosed are s full-form flat-knitted helmet shell preform, the preparation method, and the helmet shell, which belong to the field of helmet material technology. Two different knitting directions of the helmet shell preforms are prepared by means of longitudinal knitting and transverse knitting combined with partial knitting respectively; Meanwhile, reinforced yarn is added during the knitting process of the preforms to obtain the transversely and longitudinally knitted helmet shell preforms with reinforced yarn. The fabric structure of the preforms disclosed in this invention is a flat-knitted three-dimensional fabric with reinforced yarns, which solves the problem of low tensile strength and high elongation of flat-knitted fabrics, and solves the poor impact resistance caused by poor bonding strength between layers of helmet shells to some extent. Moreover, the method of preparing helmet shells from preforms improves production efficiency, reduces material waste, and solves the problem of poor dimensional stability.

3 Claims, 6 Drawing Sheets

(56) References Cited

U.S. PATENT DOCUMENTS

| | | | | |
|---|---|---|---|---|
| 6,401,262 | B2 * | 6/2002 | Bacchiega | D04B 21/16 2/456 |
| 6,536,052 | B2 * | 3/2003 | Tao | A42B 3/122 2/411 |
| 2013/0284004 | A1 * | 10/2013 | Hanks | B29C 70/56 89/36.02 |
| 2019/0344477 | A1 * | 11/2019 | Huffa | B29B 11/16 |

FOREIGN PATENT DOCUMENTS

| | | | | |
|---|---|---|---|---|
| CN | 111719225 | A | 9/2020 | |
| CN | 113085052 | A | 7/2021 | |
| JP | 2012077421 | A * | 4/2012 | D04B 1/108 |
| WO | 2017212835 | A1 | 12/2017 | |

OTHER PUBLICATIONS

Search Report issued in related Chinese Patent Application No. 202110289669.7; mailed Oct. 15, 2021; 3 pg.

First Office Action issued in related Chinese Patent Application No. 202110289669.7; mailed Oct. 22, 2021; 21 pgs.

Li, Xiaoying et al; "Knitting processes and properties of three-dimensional computerflat-knitted spacer fabrics"; Journal of Textile Research; vol. 37, No. 7, Jul. 31, 2016; pp. 66-70.

* cited by examiner

FULL-FORM FLAT-KNITTED HELMET SHELL PREFORM, PREPARATION METHOD, AND HELMET SHELL THEREOF

RELATED APPLICATIONS

The present application is a Continuation of International Application Number PCT/CN2021/119235 filed Sep. 18, 2021, and claims priority to Chinese Application Number 202110289669.7 filed Mar. 15, 2021, the disclosure of which are hereby incorporated by reference herein in their entireties.

BACKGROUND OF THE INVENTION

1. Technical Field

The invention belongs to the technical field of helmet materials, and particularly relates to a full-form flat-knitted helmet shell preform, a preparation method and a helmet shell thereof.

2. Description of Related Art

Helmet is an important individual protective device that can effectively prevent the head from being severely impacted in traffic accidents. Safety helmets can effectively reduce the risk of cranial injury caused by collisions during traffic accidents. The two important components of the helmet are the helmet shell and the buffer layer. The main role of the helmet shell is to absorb the impact energy, distribute the impact loads and prevent the penetration of sharp objects.

Currently, the helmet shell materials on the market mainly include acrylamide-butadiene-styrene copolymers (commonly known as ABS plastic) and textile composite materials. Compared with the traditional ABS plastic, textile composite have excellent properties such as light weight, compression resistance, impact resistance and cold and heat resistance, which led to the rapid development of helmet shells made of textile composite in the field of safety helmets.

Although the mechanical properties of the textile composite helmet shells are excellent, the preparation process is less automated, especially the helmet shell preforms are prepared by manual cutting and laying, which greatly reduces the production efficiency of the helmet and increases the processing cost of the textile composite helmet. In addition, after the flat fabric is cut and laid, it often needs to be extruded into the shape of a helmet shell by molding. During which the fibers and yarns inside the fabric will be stretched and squeezed, leading to a large residual stress in the composite-cured helmet shell, which ultimately results in poor dimensional stability of the helmet shell. Moreover, the textile composite helmet shell often uses high-performance fibers and their fabrics as raw materials, and the cutting method will waste expensive materials, which is not conducive to the establishment of an environmentally friendly and conservation-oriented society.

BRIEF SUMMARY OF THE INVENTION

Technical Issues

The production process of textile composite helmet preforms in the prior art suffers from low production efficiency, high processing cost, and waste of resources. Besides, the problem of poor dimensional stability of the helmet shell through cutting and layering still lacks an effective solution.

Technology Solutions

In order to solve at least one of the above problems, the invention adopts longitudinal knitting, transverse knitting and partial knitting of flat knitting to prepare helmet preforms, eliminating the need for cutting and splicing of preforms, improving the production efficiency, and reducing the waste of materials. The problem of poor dimensional stability is also solved.

One object of the present disclosure is to provide a preparation method of a full-form flat-knitted helmet shell preform, wherein the helmet shell preform is prepared with two different knitting directions, by respectively combining longitudinal knitting and transverse knitting with partial knitting; moreover, reinforced yarns are added during the knitting process to obtain the transversely knitted and longitudinally knitted helmet shell preforms with reinforced yarns.

Further, the longitudinal knitting specifically includes:

When knitting on a flat knitting machine, the knitting width is the arc length from the left ear to the right ear of the helmet shell, and the knitting width is related to the fineness of the yarns and the transverse density of the fabric; the knitting direction follows the helmet shell from the forehead to the back of the head or from the back of the head to the forehead.

Further, the transverse knitting specifically includes:

When knitting on a flat knitting machine, the knitting width is the arc length from the forehead to the back of the head of the helmet shell, and the knitting width is related to the fineness of the yarns and the transverse density of the fabric; the knitting direction follows the helmet shell from the left ear to the right ear or the right ear to the left ear.

Further, the structure of the full-form flat-knitted helmet shell preform is a flat-knitted three-dimensional fabric structure with reinforced yarns, and the basic unit knitting process is: two horizontal rows of interlock stitches are knitted on the front and back needle bed of the flat knitting machine, and then one horizontal row of non-buckling reinforcement yarns is knitted by inlay yarns, followed by one horizontal row of tuck stitch in the front and back needle bed of the flat knitting machine. After that, one horizontal row of non-buckling reinforcement yarns is knitted by inlay yarns. Finally, one horizontal row of tuck stitch is knitted on the front and back needle bed of the flat knitting machine;

Further, the tuck stitches may be knitted by skipping 1, 2, 3 or 4 needles.

Further, the method for preparing a helmet shell preform with reinforced yarns in the longitudinal knitting direction by combining longitudinal with partial knitting comprises the following steps:

The basic unit of the flat-knitted three-dimensional fabric with reinforced yarn is knitted on the front and back needle bed of the flat knitting machine, and the knitting width is determined according to the arc length from the left ear to the right ear part of the helmet shell preform. When knitting the next basic unit of the flat-knitted three-dimensional fabric with reinforced yarns, the two ends of the knitting area are respectively partially knitted by means of narrowing 4-8 stitches for each basic unit of the flat-knitted three-dimensional fabric with reinforced yarns. After a certain number of narrowing stitches, 1-2 basic units of flat-knitted three-dimensional fabric with reinforced yarns are knitted with the initial knitting width, and then, when the number of narrowing stitches reaches a certain amount in the knitting area, a partial knitting is carried out at each end of the basic unit of a flat-knitted three-dimensional fabric with reinforced yarns by widening 4-8 stitches, until the knitting width reaches the initial knitting width, so that the basic unit of a longitudinally knitted helmet shell preform is obtained. According to the actual size of the arc length between the helmet shell from the forehead to the back of the head, 6-9 basic units of longitudinally knitted helmet shell preform are knitted to form a fully formed helmet shell preform knitted longitudinally;

Further, the method for preparing a helmet shell preform with reinforced yarn in a transverse knitting direction by combining transverse and partial knitting comprises the following steps:

The basic unit of the flat-knitted three-dimensional fabric with reinforced yarn is knitted on the front and back needle bed of the flat knitting machine, and the knitting width is determined according to the arc length from the forehead to the back of the head of the helmet shell preform. When knitting the next basic unit of the flat-knitted three-dimensional fabric with reinforced yarns, the two ends of the knitting area are respectively partially knitted by means of narrowing 6-12 stitches for each basic unit of the flat-knitted three-dimensional fabric with reinforced yarns. After a certain number of narrowing stitches, 1-2 basic units of flat-knitted three-dimensional fabric with reinforced yarns are knitted with the initial knitting width, and then, when the number of narrowing stitches reaches a certain amount in the knitting area, a partial knitting is carried out at each end of the basic unit of a flat-knitted three-dimensional fabric with reinforced yarns by widening 6-12 stitches, until the knitting width reaches the initial knitting width, so that the basic unit of a transversely knitted helmet shell preform is obtained. According to the actual size of the arc length from the left ear to the right ear part of the helmet shell preform, 6-9 basic units of transversely knitted helmet shell preform are knitted to form a fully formed helmet shell preform knitted transversely;

Further, the flat knitting machine used in the method is a double-bed computerized flat knitting machine. We can knit interlocking and tucking stitches by using the same yarn guide or two different yarn guides, and another independent yarn guide is needed to knit non-buckling reinforcement yarns.

Further, the flat knitting machine equipped with a triangular system for partial knitting and at least 2 yarn guides.

Further, the yarns (knitted yarns and reinforced yarns of the preforms) used in the method include at least one member selected from the group consisting of high tenacity polyester, aramid or ultra-high molecular weight polyethylene (UHMWPE), and the fineness of the yarn used for knitting interlocking and tucking stitches shall be determined according to the gauge of the computerized flat knitting machine. The fineness of the non-buckling reinforcement yarns can be 2-5 times finer than the yarns used for knitting interlocking and tucking stitches because they are not knitted on the knitting needle, but only move between the front and back needle bed.

A second object of the present disclosure is to provide a transversely and longitudinally knitted helmet shell preform with reinforced yarns by the method of the invention.

A third object of the present disclosure is to provide a helmet shell, which is obtained by compounding the helmet shell preform of the invention with the resin.

A forth object of the present disclosure is to provide a method for preparing the helmet shell of the invention, including the following steps:

The helmet shell preforms with reinforced yarns knitted transversely and longitudinally are laid in a helmet mold in a perpendicular manner; then the resin solution is injected into the helmet molds, cured, and demolded to obtain the helmet shell.

Further, the said perpendicular manner of laying needs to ensure that the reinforced yarns in the transversely and longitudinally knitted helmet shell preforms are perpendicular to each other.

Further, the resin solution is injected by a vacuum-assisted resin injection method, and the resin solution is injected into the mold using a vacuum pump, with a vacuum degree of 0.08 to 0.1 MPa, and a further preferably 0.08 MPa.

Further, the resin solution consists of resin mixed with curing agent, including epoxy resin, ABS resin or unsaturated polyester resin, preferably epoxy resin; the mass ratio of epoxy resin to curing agent is 2:(1-1.2).

Further, the said curing is carried out initially at room temperature for 24-36 hours, followed by a secondary curing in an oven at a temperature of 50-80° C. for 1-3 hours.

Further, the releasing agent needs to be evenly wiped into the helmet mold before the preform is placed in the mold.

The invention has the following specific advantages:

(1) The fabric structure of the full-form flat-knitted helmet shell preform part of the invention is a flat-knitted three-dimensional fabric structure with reinforced yarns, which solves the problems of low tensile strength and large extensibility of the flat-knitted fabric; in addition, the three-dimensional fabric structure reduces the layup quantity of helmet shell preforms, so as to solve the current situation of poor impact resistance of helmet shell caused by poor bonding strength between layers.

(2) The full-form flat-knitted helmet shell preform part of the invention is obtained by laying a longitudinally knitted helmet shell preform and a transversely knitted helmet shell preform perpendicular to each other, which can further improves the impact resistance performance of different parts of the helmet shell.

(3) The full-form flat-knitted helmet shell is made from the full-form flat-knitted helmet shell preforms, which have a similar spherical shape. During the production process, the cutting and splicing of the preforms are eliminated. On the one hand, the production efficiency can be improved and the waste of yarns can be reduced. On the other hand, the problem of poor dimensional stability of textile composite helmet shells after curing in the prior art is solved because of the similar spherical shape of full-form flat-knitted helmet shell preform and the helmet shell, and the residual stresses generated by compression and extrusion of the fibers and yarns inside the preforms during the preparing the helmet shell are smaller.

DETAILED DESCRIPTION OF THE INVENTION

In order to make the above purposes, features and advantages of the invention clearer and easily understood, the specific embodiments of the invention will be further described below in conjunction with specific drawings.

Many specific details are expounded in the following description to provide a comprehensive understanding of the invention, but the invention can also be implemented in other ways different from those described here. Those skilled in the art can make similar modifications without departing from the concept of the invention, so the invention should not be limited by the specific embodiments disclosed below.

Embodiment 1

This embodiment provides a preparation method of a full-form flat-knitted helmet shell preform, wherein the helmet shell preform is prepared in two different knitting directions, by respectively combining longitudinal knitting and transverse knitting with partial knitting; moreover, reinforced yarns are added during preform knitting to obtain a transversely knitted and longitudinally knitted helmet shell preform with reinforced yarns.

The longitudinal knitting specifically includes:

When knitting on a flat knitting machine, the knitting width is the arc length from the left ear to the right ear of the helmet shell, and the knitting width is related to the fineness of the yarn and the transverse density of the fabric; the knitting direction follows the helmet shell from the forehead to the back of the head or from the back of the head to the forehead.

The transverse knitting specifically includes:

When knitting on a flat knitting machine, the knitting width is the arc length from the forehead to the back of the head of the helmet shell, and the knitting width is related to the fineness of the yarn and the transverse density of the fabric; the knitting direction follows the helmet shell from the left ear to the right ear or from the right ear to the left ear.

Figure 1:
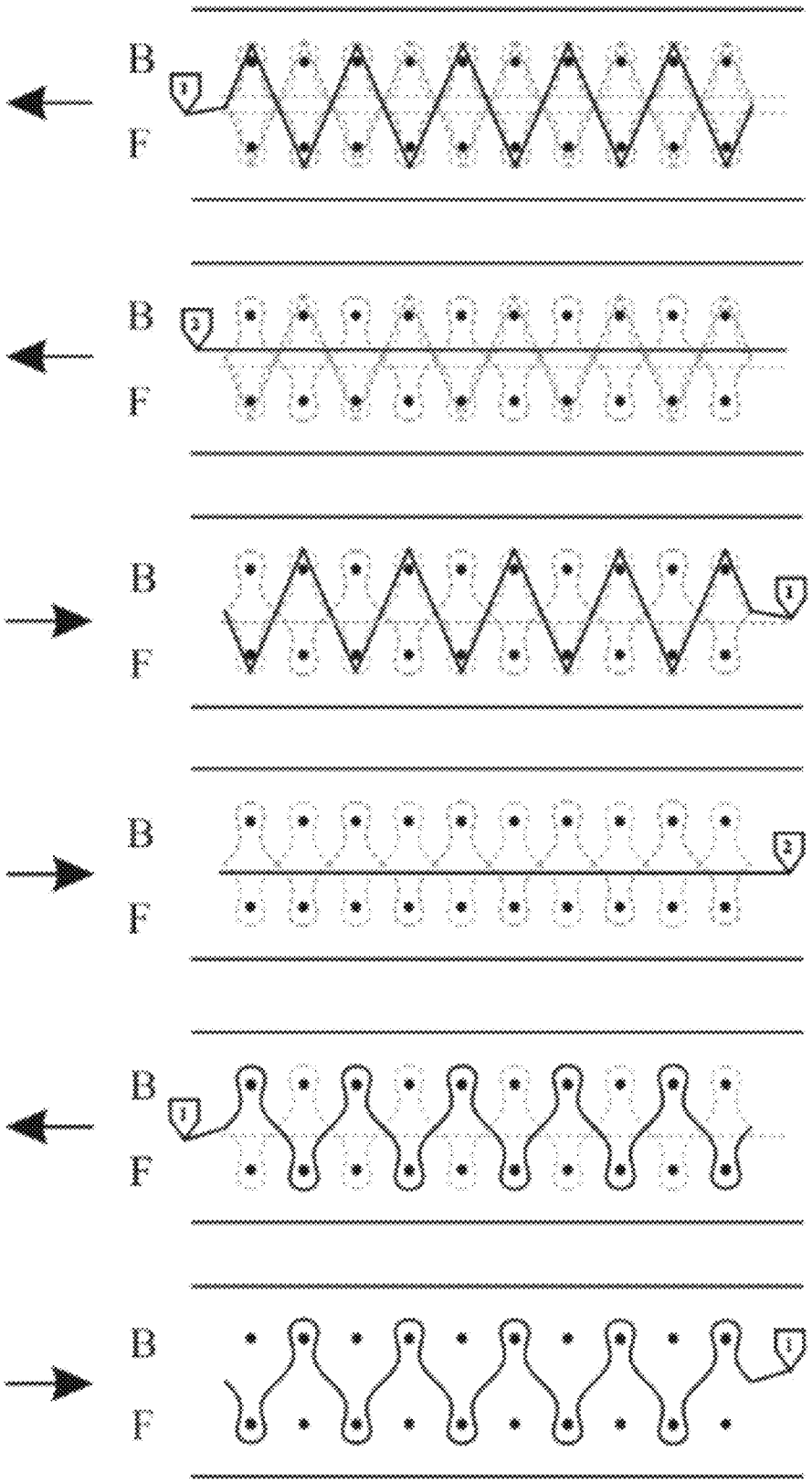
FIG. 1 is a schematic diagram of the knitting technology of a basic unit of a flat-knitted three-dimensional fabric structure with reinforced yarns.

The structure of the full-form flat-knitted helmet shell preform is a flat-knitted three-dimensional fabric structure with reinforced yarns. The three-dimensional fabric structure is formed by interlocking and tucking stitches. During the knitting process, non-buckling reinforcement yarns are added as inlay yarns to the inside of the three-dimensional fabric, resulting in a flat-knitted three-dimensional fabric structure with reinforced yarns. Adopting UHMWPE fibers to knit the full-form flat-knitted helmet shell preforms. Adopting 600D UHMWPE fibers to knit interlock and tuck stitches, while 1000D UHMWPE fibers as inlay yarns (reinforced yarns). The knitting technology of the basic unit is shown in FIG. 1: F represents the front needle bed, B represents the back needle bed.

- • represents the knitting needle of needle bed
- → and ← represent the movement direction of yarn guide, respectively represents the movement from left-to-right and right-to-left.
- 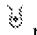 represents the stitch knitted on the front needle bed
- 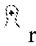 represents the stitch knitted on the back needle bed
- 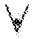 represents the tuck stitch knitted on the front needle bed
- 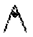 represents the tuck stitch knitted on the back needle bed
- 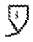 represents the yarn guide The specific knitting process is as follows:

Two horizontal rows of interlock stitches are knitted on the front and back needle bed of the computerized flat knitting machine using yarn guide 1, after which one horizontal row of non-buckling reinforcement yarns is knitted with inlay yarns using yarn guide 2, and then one horizontal row of tuck stitch is knitted in the front and back needle bed of the computerized flat knitting machine using yarn guide 1, and then one horizontal row of non-buckling reinforcement yarns are knitted with inlay yarn using yarn guide 2. Finally, one horizontal row of tuck stitch is knitted on the front and back needle bed of the flat knitting machine to form the basic unit of a flat-knitted three-dimensional fabric with reinforced yarns.

Figure 2:
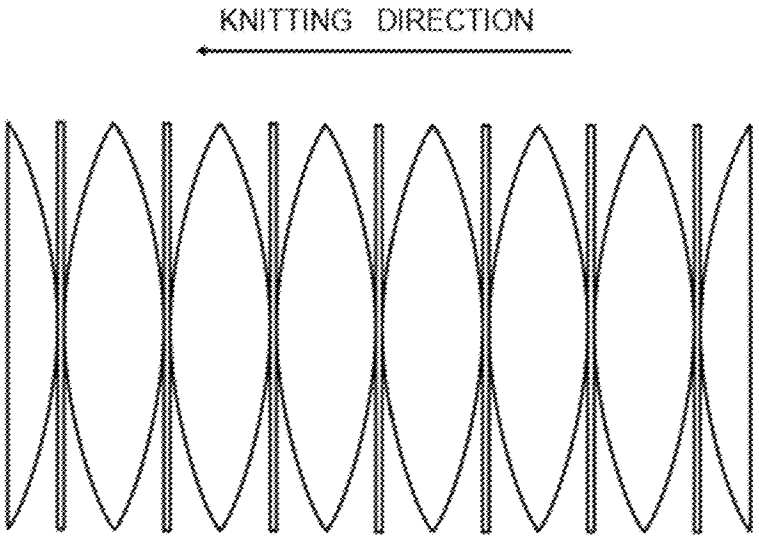
FIG. 2 is a schematic diagram of the knitting technology of a full-form flat-knitted helmet shell preform knitted longitudinally.
Figure 4:
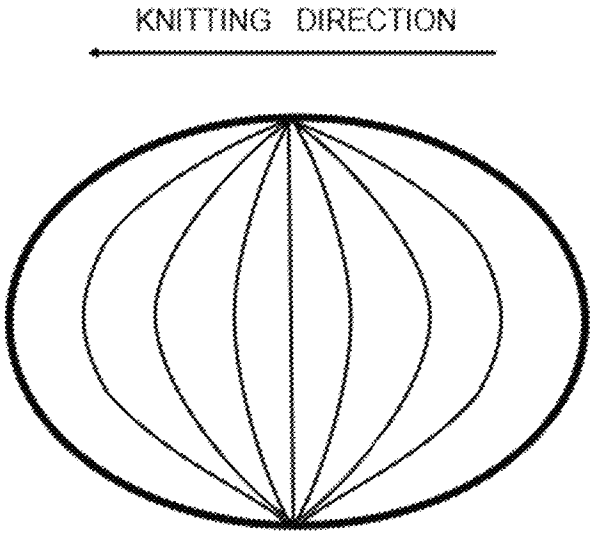
FIG. 4 is a top view of a full-form flat-knitted helmet shell preform knitted longitudinally.
Figure 5:
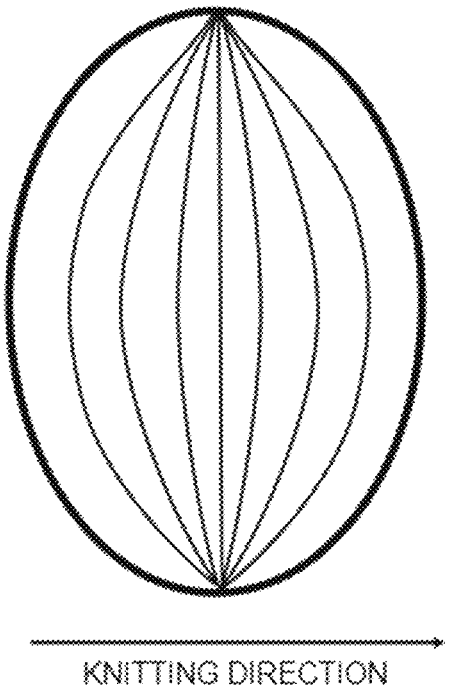
FIG. 5 is a top view of a full-form flat-knitted helmet shell preform knitted transversely.

The longitudinal knitting can realize the knitting of the helmet shell preform from the front to the back; The method for preparing a helmet shell preform with reinforced yarns in a longitudinal knitted direction by combining longitudinal and partial knitting is shown in FIG. 2, specifically as follows:

The basic unit of the flat-knitted three-dimensional fabric with reinforced yarns is knitted on the front and back needle bed of the flat knitting machine with the initial knitting width of 280 stitches. Knitting two horizontal rows of the basic units of the flat-knitted three-dimensional fabric with reinforced yarns, and then the two ends of the knitting area are respectively partially knitted by means of narrowing 6 stitches. After 15 times of narrowing, when the width reaches 100 stitches, the basic unit of the flat-knitted three-dimensional fabric with reinforced yarns is knitted for 2 rows with the initial knitting width of 280 stitches, and then, at each end of the knitting area with the knitting width of 100 stitches, a partial knitting is carried out by widening 6 stitches of the basic unit of a flat-knitted three-dimensional fabric with reinforced yarns. Until the knitting width reaches 280 stitches, the basic unit of a longitudinally knitted helmet shell preform is formed. After that, 6 basic units of the longitudinally knitted helmet shell preforms are cyclically knitted to complete a helmet shell preform in the longitudinal direction, as shown in FIG. 4.

Figure 3:
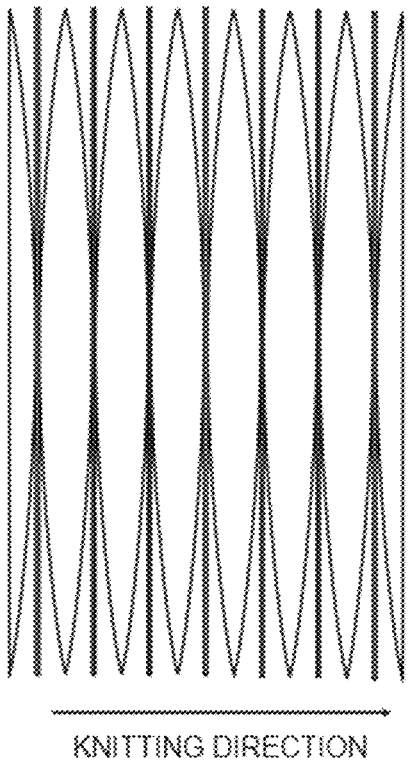
FIG. 3 is a schematic diagram of the knitting technology of a full-form flat-knitted helmet shell preform knitted transversely.

The transverse knitting can realize the knitting of the helmet shell preform from the left to the right; The method for preparing a helmet shell preform with reinforced yarns in a transverse knitting direction by combining transverse and partial knitting is shown in FIG. 3, specifically as follows:

The basic unit of the flat-knitted three-dimensional fabric with reinforced yarns is knitted on the front and back needle bed of the flat knitting machine with the initial knitting width of 360 stitches. Knitting two horizontal rows of the basic units of the flat-knitted three-dimensional fabric with reinforced yarns, and then the two ends of the knitting area are respectively partially knitted by means of narrowing 10 stitches. After 10 times of narrowing, when the width reaches 160 stitches, the basic unit of the flat-knitted three-dimensional fabric with reinforced yarns is knitted for 2 rows with the initial knitting width of 360 stitches, and then, at each end of the knitting area with the knitting width of 160 stitches, a partial knitting is carried out by widening 10 stitches of the basic unit of a flat-knitted three-dimensional fabric with reinforced yarns. Until the knitting width reaches 360 stitches, the basic unit of a transversely knitted helmet shell preform is formed. After that, 6 basic units of the transversely knitted helmet shell preforms are cyclically knitted to complete a helmet shell preform in the transverse direction, as shown in FIG. 4.

After the helmet shell preforms finished knitting, they are placed at room temperature for 72 hours, and the average thickness of one piece of longitudinal or transverse knitting helmet shell preform is 2.5 cm, which is measured on the YG141 fabric thickness tester according to the standard of GB/3820 1999 (the determination of the thickness of textiles and textile products); Fabric surface density is 821 g/m$^2$, fabric longitudinal density is 40 rows/5 cm, fabric transverse density is 28 rows/5 cm; Refer to the standard of GB/T 3923-2013 (Textile fabrics—Tensile properties—Part 1: Test of tensile strength and elongation at break (strip method)), the tensile performance of helmet shell preform was tested on MTS universal strength tester. The test results show that the transverse tensile strength is 5 times higher than the flat-knitted three-dimensional fabric without reinforced yarns, and transverse elongation at break reduced by 92%, which greatly improved the transverse tensile mechanical properties of the flat-knitted fabric, thus improve the tensile mechanical properties of the flat-knitted fabric.

Knit two horizontal rows with the initial knitting width after the completion of the partial knitting with narrowing and widening of the helmet shell preform, which can reduce or eliminate the holes caused by the partial knitting with narrowing and widening, thus solving the problem of uneven surface density of the helmet shell preforms, and improving the impact resistance of the helmet shell in the narrowing and widening part.

Figure 6:
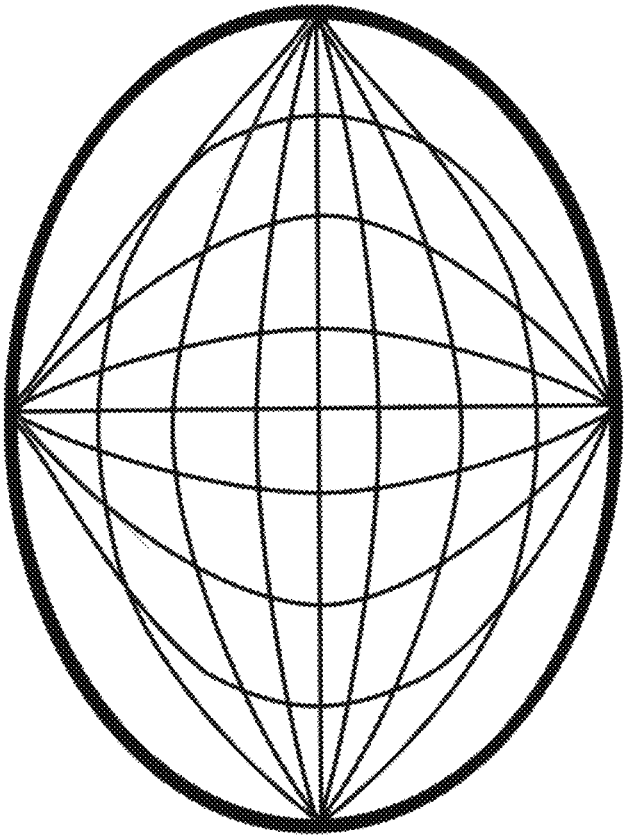
FIG. 6 is a top view of a full-form flat-knitted helmet shell preform.

As shown in FIG. 6, the full-form flat-knitted helmet shell preform is formed by laying two integrated preforms formed by longitudinal and transverse knitting in a perpendicular manner, which can make the non-buckling reinforcement yarns in the helmet shell preform with two different knitted directions approximately cross arranged in 90 degrees, and greatly improved the mechanical properties of the full-form flat-knitted helmet shell preform in different directions.

During the preparation of the preforms, the lack of reinforced yarns will lead to the large extension and low fabric surface density of the full-form flat-knitted helmet shell preforms. Moreover, the helmet shells obtained after compounding the preforms with resin have poor rigidity and large shape variable after impact, which cannot meet the requirements of impact resistance performance of the helmet shell. And by adding reinforced yarns as inlay yarns in the full-form flat-knitted helmet shell preforms can improve the tensile strength, reduce the extensibility and increase the surface density of the fabrics. The tensile performance test shows that the tensile strength of the full-form flat-knitted helmet shell preform with reinforced yarns can be increased by 5 times and the transverse elongation at break can be reduced by 92%.

During the preparation of the preforms, the desired shape of the helmet shell is knitted by using the partial knitting technology of flat knitting, and two horizontal rows of fabric with the initial knitting width of the preforms are knitted in the middle of the narrowing and widening areas, thus reducing or eliminating the holes produced at the narrowing and widening places (the holes will cause uneven surface density of the helmet shell preforms, and the prepared helmet shell will have poor impact resistance around the hole part), enhancing the mechanical properties of the connection points of narrowing and widening areas, improving the surface density uniformity of the helmet shell preforms, and thus improving the impact resistance of the helmet shell at this position.

Embodiment 2

This embodiment provides a preparation method of the helmet shell, including the following steps:

Laying the helmet shell preforms with reinforced yarns knitted transversely and longitudinally in a helmet mold in a perpendicular manner; then injecting the resin solution into the helmet molds, curing, and demolding to obtain the helmet shell.

The details are as follows:

(1) First, wiping the releasing agent in the helmet mold evenly, after which the longitudinally and the transversely knitted helmet shell preforms obtained in embodiment 1 are laid in the helmet mold in a perpendicular manner;

(2) At room temperature of 26° C., epoxy resin and curing agent were evenly mixed with a mass ratio of 2:1 to obtain resin solution. The resin is purchased from Changzhou Hualike New Material Co., LTD. The resin type is epoxy resin A02 and the curing agent is B02.

(3) The resin solution prepared in step (2) is injected into the helmet mold by the vacuum assisted resin injection process to make it fully in contact with the helmet shell prefabricated parts. After the resin solution injection is completed, the helmet mold is solidified at room temperature for 24 hours, and then it is placed in the oven at 60° C. for secondary curing for 2 hours. After cooling to room temperature, the full-form flat-knitted helmet shell was obtained by demolding.

After testing, the helmet shell obtained mass is 480 g, fiber volume content is 46%.

Comparative Example 1

Replace the "preform" in embodiment 2 with "carbon fiber plain fabric", and refer to the method in the reference (D. Thomas Campbell, David R. Cramer. Hybrid thermoplastic composite ballistic helmet fabrication study[J]. Advancement of Materials&Process Engineering, 2008, 32(3):135-146) to cut and layer the carbon fiber plain fabric to prepare the carbon fiber plain fabric helmet shell prefabricated part. By cutting and changing the number of layers, the surface density of the carbon fiber plain fabric helmet shell preform part is similar to that of the "preform" in embodiment 2. The rest is consistent with Embodiment 2 to obtain the helmet shell.

The impact resistance performance of the helmet shell prepared by Embodiment 2 and Comparative Example 1 (parameters are shown in Table 1) is tested. The test results are as follows:

TABLE 1

Parameters of the helmet shell prepared in Embodiment 2 and Comparative Example 1

| Example | Raw material | Layers of fabric | Area density of the preform(g/m$^2$) |
|---|---|---|---|
| Embodiment 2 | UHMWPEs | 2 | 1642 |
| Comparative Example 1 | Carbon fibers | 7 | 1680 |

TABLE 2

Testing results of the helmet shells prepared by Embodiment 2 and Comparative Example 1

| Example | Thick-ness(mm) | Area density(g/m$^2$) | Fiber volume content (%) | Mass(g) |
|---|---|---|---|---|
| Embodiment 2 | 3 | 3422 | 46 | 480 |
| Comparative Example 1 | 2.8 | 3308 | 44 | 468 |

Referring to the standard ASTM D7136, the impact resistance of two kinds of helmet shells was tested on an Instron Dynatup 9250 drop weight impact tester, where the total weight of the drop hammer was 7.78 kg, the end of the punch was a hemispherical structure with a diameter of 12.7 mm, and the impact energy was 20J. After the impact was completed, the carbon fiber helmet shell in comparative example 1 showed penetrating damage in the impact area, while the full-form flat-knitted helmet shell in embodiment 2 only had pits with a depth of about 4 mm.

What is claimed is:

1. A preparation method of a full-form flat-knitted helmet shell preform, wherein the helmet shell preform is prepared in two different knitting directions, by respectively combining longitudinal knitting and transverse knitting with partial knitting; moreover, reinforced yarns are added during preform knitting to obtain a transversely knitted and longitudinally knitted helmet shell preform with reinforced yarns;

the structure of the full-form flat-knitted helmet shell preform is a flat-knitted three-dimensional fabric structure with reinforced yarns, and the basic unit knitting process is as follows: two horizontal rows of interlock stitches are knitted on the front and back needle bed of the flat knitting machine, and then one horizontal row of non-buckling reinforcement yarns is knitted by inlay yarns, followed by one horizontal row of tuck stitch in the front and back needle bed of the flat knitting machine; after that, one horizontal row of non-buckling reinforcement yarns is knitted by inlay yarns; finally, one horizontal row of tuck stitch is knitted on the front and back needle bed of the flat knitting machine;

the method for preparing a helmet shell preform with reinforced yarns in a longitudinal knitting direction by combining longitudinal and partial knitting comprises the following steps:

the basic unit of the flat-knitted three-dimensional fabric with reinforced yarn is knitted on the front and back needle bed of the flat knitting machine, and the knitting width is determined according to the arc length from the left ear to the right ear part of the helmet shell preform; when knitting the next basic unit of the flat-knitted three-dimensional fabric with reinforced yarns, the two ends of the knitting area are respectively partially knitted by means of narrowing 4-8 stitches for each basic unit of the flat-knitted three-dimensional fabric with reinforced yarns; after a certain number of narrowing stitches, 1-2 basic units of flat-knitted three-dimensional fabric with reinforced yarns are knitted with the initial knitting width, and then, when the number of narrowing stitches reaches a certain amount in the knitting area, a partial knitting is carried out at each end of the basic unit of a flat-knitted three-dimensional fabric with reinforced yarns by widening 4-8 stitches, until the knitting width reaches the initial knitting width, so that the basic unit of a longitudinally knitted helmet shell preform is obtained; according to the actual size of the arc length between the helmet shell from the forehead to the back of the head, 6-9 basic units of longitudinally knitted helmet shell preform are knitted to form a fully formed helmet shell preform knitted longitudinally;

the method for preparing a helmet shell preform with reinforced yarns in a transverse knitting direction by combining transverse and partial knitting comprises the following steps:

the basic unit of the flat-knitted three-dimensional fabric with reinforced yarn is knitted on the front and back needle bed of the flat knitting machine, and the knitting width is determined according to the arc length from the forehead to the back of the head of the helmet shell preform; when knitting the next basic unit of the flat-knitted three-dimensional fabric with reinforced yarns, the two ends of the knitting area are respectively partially knitted by means of narrowing 6-12 stitches for each basic unit of the flat-knitted three-dimensional fabric with reinforced yarns; after a certain number of narrowing stitches, 1-2 basic units of flat-knitted three-dimensional fabric with reinforced yarns are knitted with the initial knitting width, and then, when the number of narrowing stitches reaches a certain amount in the knitting area, a partial knitting is carried out at each end of the basic unit of a flat-knitted three-dimensional fabric with reinforced yarns by widening 6-12 stitches, until the knitting width reaches the initial knitting width, so that the basic unit of a transversely knitted helmet shell preform is obtained; according to the actual size of the arc length from the left ear to the right ear part of the helmet shell preform, 6-9 basic units of transversely knitted helmet shell preform are knitted to form a fully formed helmet shell preform knitted transversely;

the yarns used in the method include at least one member selected from the group consisting of high tenacity polyester, aramid or ultra-high molecular weight polyethylene (UHMWPE).

2. The transverse and longitudinal knitting helmet shell preforms with reinforced yarns obtained by the method according to claim 1.

3. A helmet shell, which is prepared by compounding the transversely and longitudinally knitted helmet shell preforms with reinforced yarns according to claim 2 with the resin.

* * * * *